US010974533B2

(12) United States Patent
De Tommaso

(10) Patent No.: US 10,974,533 B2
(45) Date of Patent: Apr. 13, 2021

(54) DEVICE AND METHOD FOR THE ALIGNMENT OF A BOOK BLOCK CONSISTING OF SINGLE SHEETS AND/OR SIGNATURES

(71) Applicant: Mueller Martini Holding AG, Hergiswil (CH)

(72) Inventor: Pietro De Tommaso, Rothrist (CH)

(73) Assignee: Mueller Martini Holding AG, Hergiswil (CH)

( * ) Notice: Subject to any disclaimer, the term of this patent is extended or adjusted under 35 U.S.C. 154(b) by 0 days.

(21) Appl. No.: 15/683,864

(22) Filed: Aug. 23, 2017

(65) Prior Publication Data

US 2018/0065395 A1 Mar. 8, 2018

(30) Foreign Application Priority Data

Sep. 5, 2016 (CH) ..... 1140/16

(51) Int. Cl.

| | |
|---|---|
| ***B42C 1/12*** | (2006.01) |
| ***B42C 19/04*** | (2006.01) |
| ***B42C 19/02*** | (2006.01) |
| ***B65H 5/00*** | (2006.01) |

(Continued)

(52) U.S. Cl.

CPC ..... *B42C 1/12* (2013.01); *B42C 7/008* (2013.01); *B42C 19/02* (2013.01); *B42C 19/04* (2013.01); *B42C 19/08* (2013.01); *B65H 5/006* (2013.01); *B65H 2301/4222* (2013.01);

(Continued)

(58) Field of Classification Search

CPC ..... B42C 1/12

See application file for complete search history.

(56) References Cited

U.S. PATENT DOCUMENTS 6,267,372 B1 * 7/2001 Mylaeus ..... B65H 3/063 271/226
6,942,214 B2 * 9/2005 Riccardi ..... B65H 5/021 271/227

(Continued)

FOREIGN PATENT DOCUMENTS

DE 19653424 A1 6/1998
DE 102012018828 A1 3/2014

(Continued)

*Primary Examiner* — David R Dunn
*Assistant Examiner* — Christopher E Veraa
(74) *Attorney, Agent, or Firm* — Leydig, Volt & Mayer, Ltd.

(57) ABSTRACT

A device for alignment of a book block consisting of single sheets and/or signatures is useable in a processing machine, in which manufacturing of books or printed products is carried out. The device is arranged upstream of a first processing station within the processing machine. The book block is feedable directly or indirectly into the device automatically or by hand. An alignment station has a base plate with a substantially vertically extending stop surface at an end thereof. The base plate has a movable part configured to carry out a movement with respect to the stop surface such that the movement of the movable part, in an operative connection to the stop surface, brings about an alignment of the single sheets and/or signatures at a book block edge, and such that, following alignment, the book block is grippable by at least one transport clamp for processing.

15 Claims, 7 Drawing Sheets

(51) Int. Cl.
*B42C 7/00* (2006.01)
*B42C 19/08* (2006.01)

(52) U.S. Cl.
CPC ..... *B65H 2301/42265* (2013.01); *B65H 2301/42266* (2013.01); *B65H 2801/48* (2013.01)

(56) References Cited

U.S. PATENT DOCUMENTS

| | | | | |
|---|---|---|---|---|
| 2006/0055100 | A1* | 3/2006 | Suzuki | B65H 31/3081 270/45 |
| 2007/0097798 | A1* | 5/2007 | Awano | B42C 1/12 369/24.01 |
| 2008/0174062 | A1* | 7/2008 | Shirasaki | B42C 1/12 271/4.06 |
| 2010/0051196 | A1* | 3/2010 | Hunkeler | B42C 9/0081 156/291 |
| 2012/0267218 | A1* | 10/2012 | Nolte | B42C 19/08 198/610 |
| 2016/0325949 | A1 | 11/2016 | Muhl | |

FOREIGN PATENT DOCUMENTS

| | | | |
|---|---|---|---|
| DE | 102012023370 | A1 | 6/2014 |
| DE | 202015102333 | U1 | 5/2015 |
| EP | 2514604 | A1 | 10/2012 |

* cited by examiner

DEVICE AND METHOD FOR THE ALIGNMENT OF A BOOK BLOCK CONSISTING OF SINGLE SHEETS AND/OR SIGNATURES

CROSS-REFERENCE TO PRIOR APPLICATION

Priority is claimed to Swiss Patent Application No. CH 01140/16, filed on Sep. 5, 2016, the entire disclosure of which is hereby incorporated by reference herein.

FIELD

Within the scope of processing book blocks consisting of single sheets and/or signatures, in particular in a processing machine designed as a perfect binder line, also called a perfect binder, the importance of seamless production of a plurality of jobs one after the other without carrying out change-over processes increases. This is all the more important if it is assumed that in the future, print runs, i.e. the number of books in each case, will vary greatly right through to very small print runs or a single book per job. Therefore, in terms of definitions hereinafter, a book block shall be taken to mean the collection of single sheets and/or signatures that are loose per se, whereas a book shall be understood to be the result once such a book block has finished being processed.

Said trend towards very small print runs will rapidly increase in importance in particular in the digital environment. It is obvious that in the case of this trend, job-related setting up will greatly affect the net output of a line, and will become a crucial factor in terms of economic efficiency.

Furthermore, no compromises may be made with respect to quality assurance, for example when it must be ensured that the book blocks being processed to make books always exhibit optimal processing even in the case of very small print runs.

In the technical field of the present invention, the aim is therefore to propose how a reliable alignment of the edges of a book block consisting of compiled single sheets and/or signatures from the outset can be accomplished when the book block is processed across a plurality of processing stations.

As mentioned above, a perfect binder line is the focus here as the processing machine; this constitutes the standard design for adhesive-bound products, but should not be understood to be exclusive.

BACKGROUND

DE102012023370 A1 discloses a perfect binder which is intended for the manufacture of books and has a plurality of processing stations such as a book block insertion station, spine processing station, glue application station, folding station, cover feeder, cover press station, delivery station and drying station. Furthermore, the perfect binder has at least two, but in particular three, transport clamps for transporting book blocks and at least one closed guide track on which the transport clamps circulate and pass the processing stations. A drive having an endless circulating pulling means is assigned to one transport clamp in each case, one transport clamp being connected to the pulling means in each case. Here, the drives operate independently of one another and can be actuated independently by a machine control system of the perfect binder. Therefore, one pulling means is provided for each transport clamp and each transport clamp can thus be moved at a speed predetermined therefor, i.e. a varying distance between the transport clamps is produced.

For this purpose, location-dependent and/or product-dependent speed profiles can be stored in the machine control system for actuating the drives. Location-dependent speed profiles that are dependent on the product and vice versa are also possible. In this case, location-dependent speed profiles means that along the closed guide track, movement portions are defined which are each limited at least by the stopping positions. In this manner, for example, an associated idle time can be stored for each stopping position. A different speed can also be stored for each movement portion between the stopping positions; for example the speed in the spine processing station may be greater than in the drying station. "Product-dependent speed profiles" means that said profiles depend on the book to be manufactured, i.e. for example on its dimensions, the thickness of the book block, the thickness of the glue, the adhesive and its properties, the paper material, etc.

This perfect binder undisputedly has the advantage that as a result of adjusted idle times and different movement profiles in the movement portions, the output of the perfect binder can be increased. The quality of the books to be manufactured can also be increased since the speed profiles each allow transport speeds and idle times approaching the processing optimum. In this manner, for example, a longer idle time for pressing on the covers can contribute to a cover sticking better to the book block in each case, the book block spine can be shaped better and the book block can cure better. A further advantage emerges in that processing stations located at the stopping positions can be at any chosen location along the guide track, i.e. can be arranged in an optimal position. It is no longer necessary to arrange the stopping positions at an equal distance from one another. The processing stations can be arranged variably along the guide track according to customer requirements using a grid. In this way, different machine configurations can be offered by the machine manufacturer in a simple manner.

Said perfect binder has in particular at least two stopping positions for the transport clamps, one of which is for the book block insertion and one is for pressing a cover onto a book block. If applicable, one additional stopping position can be provided for the discharge of finished book blocks. In each of the stopping positions, the transport clamps are brought to a standstill by the drive assigned to each of said transport clamps. It is also possible, for example for manufacturing lay flat brochures, Swiss brochures and Otabind, to apply adhesive and lining strips during the first circulation of the book block along the guide track and then adhesive and a cover during a second circulation of the book block along the guide track.

In contrast to the high-performance perfect binders, for example to the ALEGRO perfect binder from the company MUELLER MARTINI AG, Switzerland, in the case of which perfect binder the processing of the book block is undertaken at a plurality of stations by means of a greater number of revolving transport clamps, and thus the perfect alignment of the book block to be processed can be achieved along a longer distance, this option is not available for the present underlying perfect binder (see DE102012023370 A1), i.e. the perfect alignment of the book block must be achieved or produced originally right at the beginning of the processing procedure.

According to the prior art, a perfect binder normally comprises the following processing stations: a spine processing station, a glue application station, a station as a cover feeder, and a pressing station for affixing the cover. In addition, complementary elements can also be added such as a book block transport system, book block insertion station, intermediate drying, spine reinforcement and others. The listed processing stations should not be understood to be exhaustive.

It is true that a feed operation carried out and aligned by hand could be avoided in the case of such a perfect binder; however, this is not the objective of automated production according to 4.0 criteria (see the homepage of MUELLER MARTINI AG, Switzerland, under "Finishing 4.0"), such that automatic book block feeding, i.e. automatically, continuously ensuring a perfectly aligned book block consisting of single sheets or signatures, must be provided at the beginning of processing.

Another similar perfect binder line is disclosed in DE102012018828 A1. This publication therefore concerns a book binding machine for producing printed products, such as books, magazines and brochures, having a plurality of processing stations such as a book block insertion station, spine processing station, glue application station, cover feeder and pressing station, and having a book block transport system which transports the book blocks through the individual processing stations. The book block transport system has a closed guide track having straight, arcuate and curved regions and clamps for clamping the book block, the clamps having guide carriages with guide rollers which roll along the guide track, and the clamps being driven collectively or individually by a drive.

The guide carriages in the present case comprise three fixed guide rollers which are fastened to the guide carriage in the form of a triangle, two guide rollers running along a master track which consist of linear, arcuate and curved track-shaped parts, and the third guide roller running along a slave track that is produced in accordance with mathematical and geometric laws and likewise consists of linear, arcuate and curved track-shaped parts, the guide carriages being coupled to at least one drive which is arranged outside the guide track.

The content of the two aforementioned publications constitutes an integral part of the present description, the number of guide rollers as specified in DE102012018828 A1 representing a limitation to or increase in their quantity.

DE202015102333 U1 relates to a goods processing device for laying out and separating flat goods, having a layout deck and a layout device as well as a supply deck and a separating device. One part of the layout device is arranged underneath the layout deck of the goods processing device and the supply deck comprises an opening for a separating drum with one part of the separating device, which is arranged above the supply deck.

The aforementioned part and the separating drum form a main discharge of the separating device for separating a stack of flat goods, a control unit being provided to control the layout device and the separating device. The layout device is equipped for aligning the edges of a stack (ST) of flat goods having different dimensions and has at least two transport elements (141 . . . 14*x*) which allow an automatic movement of the stack (ST) transversely to the transport direction x and placement of the stack (ST) against an alignment wall (11) and transporting of the stack (ST) in the transport direction x to the feed deck (13, 21) of the separating device as well as a movement of the stack (ST) counter to the transport direction x.

A movement means is provided for moving the part (265, 269*) of the separating device in a direction counter to the transport direction x and means for controlling the alignment state of the transport elements of the layout device of the goods processing device (1) and for controlling the movement of the part of the separating device, the aforementioned part allowing a movement of the stack counter the transport direction x.

Furthermore, the separating device according to DE202015102333 U1 is based on the flat goods being transported such that they are lying on their side.

EP2514604 A1 concerns a supply device, which is used in a book binding machine or perfect binder, the unbound book blocks being aligned in this case by a vibrating device.

DE19653424 A concerns a device for separating sheet goods from a stack.

SUMMARY

In an embodiment, the present invention provides a device for alignment of a book block consisting of single sheets and/or signatures which is useable in a processing machine, in which manufacturing of books or printed products is carried out. The device is arranged upstream of a first processing station within the processing machine. The book block is feedable directly or indirectly into the device automatically or by hand. At least one alignment station has at least one base plate with at least one substantially vertically extending stop surface at an end thereof. The at least one base plate has at least one movable part configured to carry out at least one movement with respect to the stop surface such that the at least one movement of the at least one movable part, in an operative connection to the stop surface, brings about an alignment of the single sheets and/or signatures at at least one book block edge, and such that, following alignment, the book block is grippable by at least one transport clamp for processing.

BRIEF DESCRIPTION OF THE DRAWINGS

The present invention will be described in even greater detail below based on the exemplary figures. The invention is not limited to the exemplary embodiments. All features described and/or illustrated herein can be used alone or combined in different combinations in embodiments of the invention. The features and advantages of various embodiments of the present invention will become apparent by reading the following detailed description with reference to the attached drawings which illustrate the following.

DETAILED DESCRIPTION

Figure 1:
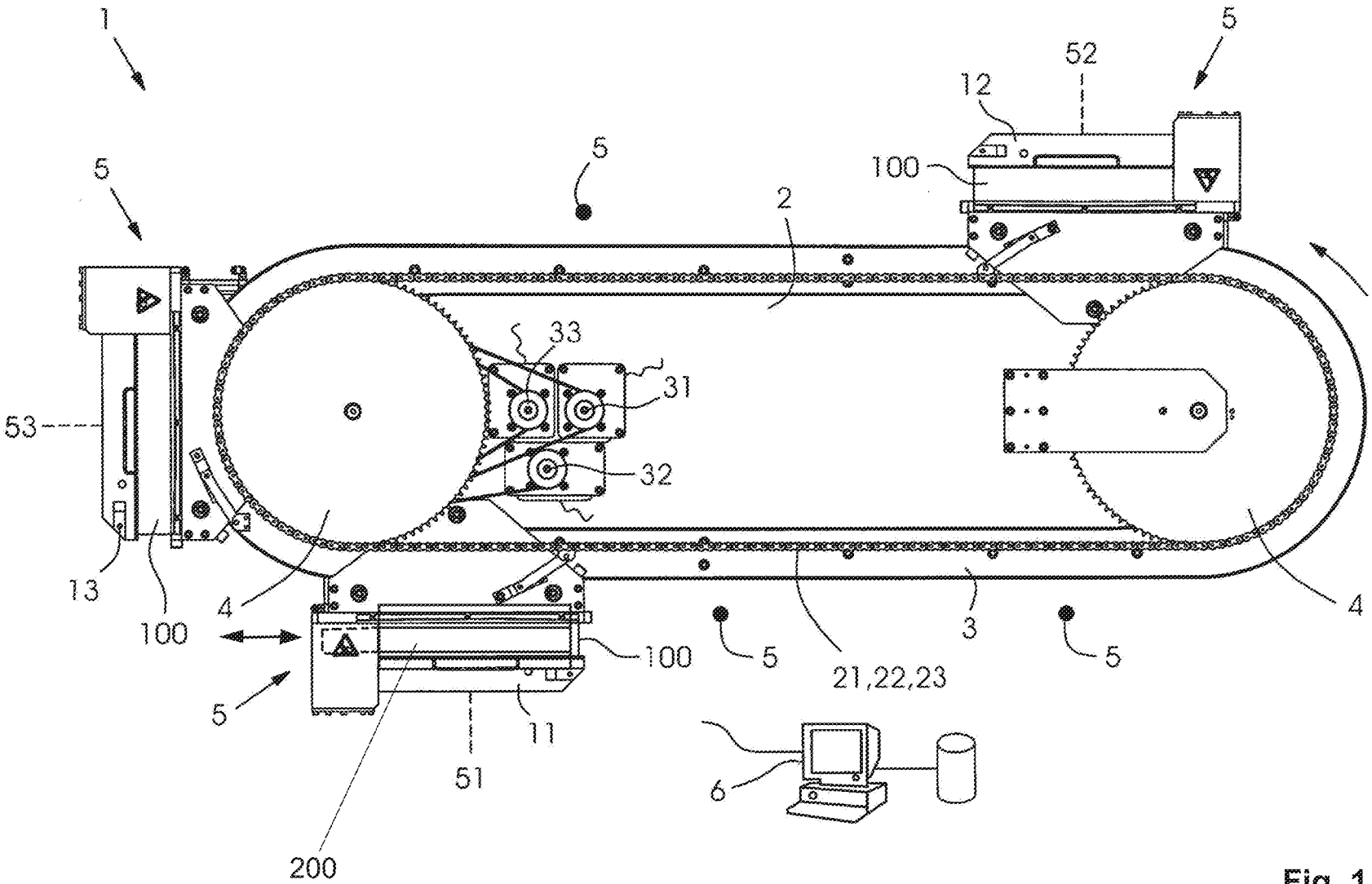
FIG. 1 is a plan view of a perfect binder.

An embodiment of the invention builds upon the prior art. According to an embodiment of the invention, it is possible to manufacture adhesive-bound books from preceding book blocks having various dimensions and job sizes, either by means of a continuous automated supply, or as required, by manual feeding, having minimized idle times between the individual jobs, the starting point being providing book blocks which consist of compiled single sheets and/or signatures, and the edges of which must be aligned perfectly prior to their processing to make books or printed products.

If the use of a perfect binder line according to DE102012018828 A1 is intended, then a development according to an embodiment of the invention is put forward in that the number of guide rollers of the individual guide carriages is not limited to three, but rather the guide carriage can have a plurality of guide rollers on each side (master track/slave track).

If an automated book block supply is taken as the basis, it is important, in particular for perfect binder lines with a low number of transport clamps, that an initial perfect alignment of at least one book block edge is undertaken before said book block is transported to the processing stations of the processing machine. Not just a minimization but rather a total elimination of the idle times between the various consecutive jobs can thus be achieved.

According to an embodiment, the invention comprises a development of the perfect binder line, which development concerns providing means directly upstream of the first processing station of the perfect binder line, which means have the ultimate purpose of consistently and perfectly aligning the edges of the book blocks supplied in their loose or semi-loose condition before they are supplied for subsequent processing.

In the case of the means used according to an embodiment of the invention for achieving a perfect alignment of the book blocks, their continuous, automatic delivery is certainly a focus; however, said means for achieving a perfect alignment of the book block should also be available or used if single or multiple book blocks are introduced into the perfect binder line by hand.

The means used for this purpose consist of technical features, which are used preferably in combination or such that they are operatively connected to one another.

A first technical feature involves a base plate being provided at the beginning of the perfect binder line, which base plate functions as the starting station for receiving the continuously or intermittently supplied book blocks and on which, in an operative connection to other features, the basic alignment of the book block takes place.

Firstly, said base plate is coupled to a vibrating mechanism, the function of which is certainly to commence separation of the single sheets and/or signatures as sustainably as possible and to implement an alignment tendency.

The minimum vibration time is approximately 1 second. Depending on the settings of the pressing time or the thickness settings to be implemented at the following processing stations, the vibration time can also be longer.

However, it has been shown in practice that no 100% operative certainty can be achieved by this vibration function alone that an orderly alignment of at least one book block edge can be achieved thereby in comparison with the components of the book block that arrive loose.

Therefore, the perfect alignment of the book block according to an embodiment of the invention is achieved in that a movement acting on the book block is introduced in an operative connection to a stop surface which extends vertically or virtually vertically and is arranged at the end of the base plate, which movement ensures that a 100% defined alignment of the entire book block is achieved.

Therefore, if no 100% alignment can be achieved by the vibratory movement alone, then individual book block parts or single sheets which are not 100% perfectly aligned could be detected early by a light barrier directed onto the stop surface, which acts as a presence control for the book block, whereupon, following on directly from said findings detected by the light barrier, the further processing steps can be initiated, in particular such that the transport clamp then starts to function, whereupon the book block is transported onwards to a first processing station. A correction of a deficient alignment of individual components of the book block can then no longer be remedied.

An existing deficient alignment in particular of the rear edge of the book block after activating the transport clamp, even if the error is still minimal, inevitably leads to losses in quality of the finished book, apart from the processing of such a non-100%-aligned book block also possibly being the cause of triggering damage within the individual processing stations.

According to an embodiment of the invention, however, the vibratory function should not be omitted because such a function proves to be advantageous for the separation of the single sheets or signatures within the book block. Nevertheless, the presence control of the light barrier should then no longer be carried out on the book block in isolation and as a critical factor as a function of the vibratory function, but rather should now only intervene after the alignment procedure is completed since the perfect alignment of the book block is now only achieved when said light barrier detects that the entire book block integrally lines up with the fixed-position stop surface. The transport clamp only begins to function at this point.

This state is achieved using means according to an embodiment of the invention, which are kinematically designed such that they lead to a perfect alignment of the book block, and therefore these measures according to the invention are superimposed on the vibratory function when the aim is to ensure the required alignment of the book block.

This is achieved according to an embodiment of the invention in that the ultimate stop position of the book block is achieved by at least one additional movable means, which acts over and above the vibratory function. If required, additional damping measures are then provided in the region of the fixed-position stop surface, which measures achieve a suppression of a movement-related "bouncing" of the rear stop edge of the book block with respect to the fixed-position stop surface.

The provided movement profiles of the movable means used in each case are, however, designed per se such that said damping measures can normally be omitted. As a preventive measure, however, the element of the book block constituting the stop surface should be designed such that the integration of such damping measures is possible at any time.

Said stop surface is normally designed as a perfectly vertically oriented wall of the base plate such that the rear edge of the book block and therefore also the other book block edges form right angles to one another.

The movement acting on the book block to achieve a 100% matching position of the rear stop edge of the book block with respect to the fixed-position stop surface at the end of the base plate consists of the base plate being enhanced with means that implement at least a backward movement of the book block with respect to the fixed-position stop surface.

Preferably, said means engage on the lower edge of the book block when the movement is carried out, the force fit between said lower edge and the adjacent upper surface of the means used predominantly being injected by the weight of the book block, the movement of the book block not necessarily being completed when said book block first abuts the fixed-position stop surface, but rather the sought perfect alignment can be maximized as required when the backward movement of the means acting on the book block is also briefly continued after the contact with the stop surface. This, however, requires the book block to have a certain ability to remain in position in an operative connection to the surface of the means that are acting underneath. Said state of remaining in position can then advantageously be transferred to the alignment of the book block if the vibratory function simultaneously remains functioning. This is possible because the transport clamp, which is still open, still has a sufficiently large lateral clearance with respect to the book block. The light barrier only releases the transport clamp after the completion of said alignment.

It can also be provided for the backward movement of the means to carry out a brief sweeping movement in the forward direction after a first contact between the rear book block edge and the stop surface, in order to then press said book block edge against the stop surface again by means of a renewed backward movement. If this renewed measure is combined with the vibratory function, a perfect alignment of the loose single sheets and/or signatures of the book block can then be achieved reliably if an internally particularly strong surface tension or friction prevails among said single sheets and/or signatures.

In the case of an automated book block supply, said backward movement of the book block against the fixed-position stop surface according to the invention can also be used in perfect binder lines in which rapidly changing jobs are processed.

When a fixed-position stop surface is referred to here, this means that the position is initially fixed per se, but also that said stop surface can be relocated selectively to assume a new fixed position as required, a dynamized movement of the stop surface in both horizontal directions also being possible.

According to the invention, one embodiment of said means for backward or forward movements of the book block to the stop surface, which is in a fixed position at the end of the base plate, consists of retracting elements or retracting units, which have and fulfil various designs and modes of operation.

A first embodiment of said means according to the invention is that retracting elements act on the surface of the base plate, which elements directly support the book block consisting of single sheets or signatures, said retracting elements carrying out an independent and substantially consistent movement when released from the base plate, an end of the retracting element on the stop surface side being coupled for this purpose to a drive which implements the movements that are to be effected. Said drive can either function or start functioning during the vibratory movement or only after said movement has finished.

Such a retracting element preferably consists of a retracting belt or a retracting plate, which in principle carry out the same kinematic processes and movements.

When backward movements of the movement element being used, namely a retracting belt or retracting plate, are referred to here, as described above, then this shall not only be understood to mean that only one specific fixed movement takes place in one direction: in order to achieve a perfect alignment of the book block, intermittent brief movements away from the stop surface can also be provided, as briefly described above, which movements can also contain a sweeping movement, and which lead to a sustained alignment of the loose components within the book block, in particular if the vibratory function is also still operational during such processes.

In principle, the retraction function carried out by the retracting belt or the retracting plate is ended when the message is issued that the perfect positioning of the rear stop edge of the book block with the stop surface is completed. The surface of such a retracting element on the book block side should preferably be provided with a grip structure which is intended to increase the grip with respect to the lower book block edge such that even in the case of intermittent movements of the retracting element in one or the other direction, a reliable transfer of force onto the book block takes place.

If the book block is formed by thin single sheets with a tendency to develop a high, reciprocal surface tension or friction, it can be provided for the retracting element, i.e. the retracting belt or retracting plate, to carry out intermittent backward and forward movements shortly after one another, with the ultimate purpose of ensuring an alignment of the components of the book block lasting beyond the vibratory function.

Therefore, a movement dynamic of the relevant retracting element can also be provided, during which movement the leading of the book block as far as against the stop surface is not deemed to have been completed after the first contact in terms of quality assurance, but rather is repeated at least once more in that the retracting element carries out a sweeping movement forwards.

As a result of this repetition of the movement(s) of the retracting body, the rear stop edge of the book block can therefore be aligned perfectly and homogenously according to the extension of the stop surface of the base plate before the book block is clamped by the transport clamp for onward transport, it being such that, in geometrical terms, the rear stop edge is opposite the leading edge of the book block.

The book block is initially transported onwards from the base plate towards the processing station while the retracting element is idle, the lower edge of the book block, which forms a right angle to its rear edge, either slides on the surface of said retracting element or the book block is raised slightly from the surface of the retracting element after the clamping operation for onward transport. This dynamic measure can be advantageously applied in particular if the surface of the retracting element has to be provided with a rather rough grip structure.

If it is intended to raise the book block from the surface of the retracting element for transport towards processing, said retracting element will immediately resume its original position for the next cycle directly after the raising of the book block has been executed by means of a reverse movement controlled by a drive.

The kinematics described above with respect to the retracting element can also be achieved according to the invention if the backward movement of the book block is brought about by a continuously circulating conveyor belt, which describes a flat, guided path in the region of the base plate. Apart from this, the same considerations apply here as described above in connection with the retracting belt or retracting plate.

Another variant according to an embodiment of the invention with respect to ensuring the movement, in particular the backward movement, of the book block entails providing the base plate at least partially with rollers mounted inside, which directly or indirectly transfer a rotary movement onto the book block via a drive, these rollers only projecting slightly above the surface of said base plate.

It can then also be provided for the drive of the rollers to be taken out of operation briefly after the book block has abutted the fixed-position stop surface such that the rollers can then freely rotate practically without friction; this is so that no inhibitory effect on the book block can be caused by the rollers during onward transport, preferably even in cases in which the book block is not raised for onward transport.

After the book block has abutted the fixed-position stop surface, the rollers accordingly instantly no longer have any torque, or the torque for the rolling movement is designed such that the rollers are initially idle after the abutment and then only rotate freely when the book block is transported onwards. During the subsequent cycle, the rollers are initially driven again until abutment of the book block has occurred.

Another variant entails the base plate integrally consisting exclusively of rollers arranged next to one another which act transversely to the rear edge of the book block. Said rollers then form a coherent roller conveyor. Apart from this, the dynamic operation of such a roller conveyor comprising the rollers already described above as integrated into the base plate can be carried out.

Another variant entails the stop surface, which has already been described in detail, no longer being fixed in position, but rather carrying out at least one forward pushing movement directed towards the book block, the book block either being pushed between the clearance of the transport clamp, which is still open, or in that the transport clamp carries out the movement of the stop surface ahead of or congruent with the movement. In both cases, the alignment of the book block is deemed to have been completed when the leading book block edge has reached a specific position either mechanically or by means of sensor control. The mechanical stop can be constructed such that it initially exerts a slight counterforce onto the book block before it releases the onward transport path by means of a tipping movement. The transport clamp only begins to function when the perfect alignment of the book block has thus been achieved and the clamped book is then supplied to the first processing station.

In all the described retraction movements or other movement characteristics, the transport clamps used adapt to the aligned plane of the rear book block edge as a result of an integrated clamp carrier such that the book block that is then lined up is always detected appropriately to its position and with positional stability.

Additionally, according to an embodiment of the invention, a method for operating at least one processing machine designed as a perfect binder line is also introduced, this perfect binder line being operatively connected to the operation of a device described above for aligning a book block consisting of single sheets and/or signatures, the book blocks preferably being supplied automatically. It is, however, also possible to then insert the book blocks by hand and then to undertake their alignment with the aid of one of the described variants of the device for aligning a book block consisting of single sheets and/or signatures, such an insertion ensuring that a perfect alignment of the book block is provided in every case. Both kinds of supply, automatic or manual, can be carried out at the same place or a separate place.

Said processing machine, i.e. the perfect binder line, can be operated according to the following method steps, it frequently being possible to omit a temporary standstill in the flow of book blocks in perfect binder lines having only a few processing stations and a greatly limited number of transport clamps because in such cases, the processing stations have a sufficiently long interval available for change-over.

The implementation of such production of various jobs is based on the use of barcode information, which is known per se from prior art, which is placed on the book block as well as on the cover so as to be readable and has the ultimate purpose of establishing and transporting association with a job.

When processing certain jobs that require longer time intervals for changing over the processing stations, the following process steps are taken as the basis:

i) when changing over from a continuously produced first job to a subsequent second job, the introduced book blocks of the subsequent job are detected using barcodes, and before they are inserted into the processing machine, they are stopped in front of the device for aligning the book block;

ii) while the book blocks of the subsequent job remain waiting in front of the device operated for alignment, the remaining book blocks of the preceding job are guided through the individual processing stations of the processing machine and are finished;

iii) after the last book block of the preceding job is finished, empty drawing of covers belonging to the subsequent job stored in a cover feeder is initiated until it is ascertained that said covers will definitely be available for the book blocks of the subsequent job;

iv) as soon as it has been ascertained that the cover that has been drawn off definitely matches the book block of the subsequent job, the main control system of the processing machine releases the stopped book blocks of the subsequent job, which are then inserted into the processing machine and are then processed by the individual processing stations.

Accordingly, even in the case of perfect binder lines having a reduced number of processing stations and transport clamps, the brief stopping of the book block supply between two different jobs per se is also justified. In most cases, though, such a short intermediate interval is already sufficient to undertake the necessary change-over at the processing stations and supply functions (drawing off of the covers).

Since, therefore, the idle times while the book blocks are stopped correspond at most to the number of operational processing stations of the perfect binder line, the interruption of production is always very limited, irrespective of the size of the job and irrespective of how long the change-over takes.

The fact that the ratio between the adjustment and processing portion along the conveyor line of the perfect binder line does not have to be varied is to be regarded as advantageous in the case of such an arrangement, and this contributes to the simplification and stability of the system. The time required due to idle times that absolutely have to be undertaken for the job change-over is also of lesser significance due to another consideration, as it will presumably rarely be the case that such a change-over of the processing station cannot be undertaken within the predetermined cycle of a perfect binder line having a reduced number of transport clamps.

In most cases apart from this, such a change-over will be able to take place within one single idle time if necessary. Therefore, the dimensions of the subsequent book blocks would have to have a greater variability until the conditions of a job stop are met, which cannot be ruled out, however, as part of the wide variability of printed products.

If, in an extreme case, very small job sizes or single printed products are to follow on from one another, then it is proposed according to the invention to scan the covers externally beforehand and to transmit the resultant sequence electronically to the main control system of the perfect binder line. The book blocks released for processing then depend on the resultant sequence based on the scanned covers.

Book blocks with changing thickness within a certain bandwidth can still be continuously produced without intervention in perfect binder lines with few processing stations and transport clamps such that, in such cases, the production of the printed products with thickness differences far exceeding the variability of ±3.25 mm thickness difference, as is specified in runs in high-performance perfect binders, can take place without having to provide for further interventions before a changeover is made, as required, to a higher or lower bandwidth for larger or smaller book block thicknesses. The procedure always corresponds to the operating processes described above.

It is accordingly the case that change-over at the processing stations of the processing machine is omitted for printed products having the same dimensions, in particular with respect to the thickness, and having different covers. In contrast, in the case of a change of the original thickness of the book block within various jobs beyond the minimum margin specified by the type of perfect binder line, an adjustment of at least one processing station of the machine is undertaken.

Furthermore, a change-over of the processing stations of the perfect binder line is then carried out if there are changed dimensions of the book block, such as width and height, or if its thickness exhibits a difference from the start which is greater than the minimum margin. Large or larger differences in the dimensions of the book blocks can thus be processed with minimal effort.

The manufacture of adhesive-bound books can be designed advantageously using digital printing. Using such a high-performance system in which digital printing and processing are integrated into one complete system, it is possible to offer fully automated production in one single work step, from roll to finished print product, it even being possible for very small print runs to be produced extremely quickly and economically.

The high-performance system in question is ideally suited to provide an industrial, fully integrated complete solution for digital book production, with which, as mentioned above, even very small print runs right through to single books or brochures, can be run economically. The data control and regulate the pre-press stages, the digital printing and processing of the printed products generally in a high-performance perfect binder line through to completion of the books or brochures.

If the characteristics, which are detected electronically via the barcodes, of the book blocks, which are initially on hold before the processing stations, indicate that a change-over or adjustment of one or more processing stations of the perfect binder line absolutely must be undertaken, then these interventions can be initiated and accomplished continuously as soon as the last book block of a preceding job has left this particular processing station in each case.

It can thus be achieved that the processing of the subsequent job can be released directly as soon as the message reaches the main control system that the appropriate covers assigned to the new job are ready to be drawn off.

If the covers are scanned in externally beforehand, as described above, then a prior step of ensuring by drawing off the covers is normally omitted.

The values underlying these adjustments can be directly called up provided the control profiles to be used therefor are stored in the main control system of the perfect binder line. If there are not yet any control profiles stored for a certain book block, then the electronically recorded properties and characteristics of the book block waiting to be processed ensure that the main control system issues corresponding, compliant control commands to the units and processing stations of the perfect binder line, which are then directly implemented automatically.

This is self-evidently conditional upon at least the processing stations being equipped with appropriate servo motors which are capable of storing the commands in terms of control technology in order to then implement them very precisely. This storage then meets the condition of a stored control profile per se. The electronically detected properties of the relevant book block can be detected by sensors, or they are encoded in a barcode. If the processing stations are equipped with appropriate servo motors, then manual adjustments are no longer necessary at all.

The stored control profiles can also be designed such that they can be reviewed, adjusted and/or directly corrected accordingly depending on feedback originating from a processing station.

For different book block thicknesses in particular, the geometric position for scoring the covers should preferably be adjusted. For a cover made from a rather inflexible material, a double folding should be undertaken in accordance with the book block thickness prior to said application.

In the case of a change in the dimensions of the book block, as already mentioned, at least the processing stations of the perfect binder line are adjusted to the dimensions of the subsequent job, it being possible for such a change-over to be achieved preferably by activating the control profiles which are stored or calculated in the main control system, the change-over operations taking place continuously at every processing station as soon as the last book block of the preceding job leaves such a processing station, in order to achieve the best possible reduction in stoppage times.

In summary, the method can be described as follows: prior to release of the book blocks belonging to the subsequent job, it is ensured by empty drawing off of at least one cover that this precise cover matches said subsequent book blocks. It is also possible, again prior to release of the book block belonging to the subsequent job, to ensure that the cover for said subsequent job is detected and is then directly available without empty drawing off.

Furthermore, it is also possible prior to the release of the book block of the subsequent job to ensure that all surplus covers of the preceding job are drawn off empty from the cover feeder until the matching cover for the book blocks belonging to the subsequent job is detected.

FIG. 1 is a plan view of a perfect binder 1, also referred to as a perfect binder line. The perfect binder 1 has a book block transport system 2, which is moved by the transport clamps 11, 12, 13 along a guide track 3 (see FIG. 2) through processing stations 5 arranged along the guide track 3. The perfect binder shown in FIG. 1 has three drives 41, 42, 43 (see FIG. 2), the first drive 41 being assigned to the first transport clamp 11, the second drive 42 being assigned to the second transport clamp 12 and the third drive 42 being assigned to the third transport clamp 13. Each drive 41, 42, 43 has a drive chain 21, 22, 23, to which the assigned transport clamp 11, 12, 13 is fastened and which is driven by a drive motor 31, 32, 33. The end of each drive chain 21, 22, 23 is operatively connected to a sprocket wheel 4. Here, the drive motors 31, 32, 33 are actuated by a machine control system 6 of the perfect binder 1. Speed profiles are stored in the machine control system 6 such that each transport clamp 11, 12, 13 can be moved at its own speed profile along the guide track 3 (see FIG. 2). For example, different lengths of idle time can be stored in the machine control system for each stopping position 51, 52, 53. For example, the idle time in the stopping position 53 for the book output can be considerably shorter than the idle time in the stopping position 52 for pressing on the cover. A specific speed can also be provided for each processing station 5; for example the speed in the drying station 5 can be particularly low in order to allow a long drying process and cooling process. Product-dependent speed profiles, i.e. speed profiles depending on each book block 100 to be processed, can also be stored in the machine control system 6.

Figure 2:
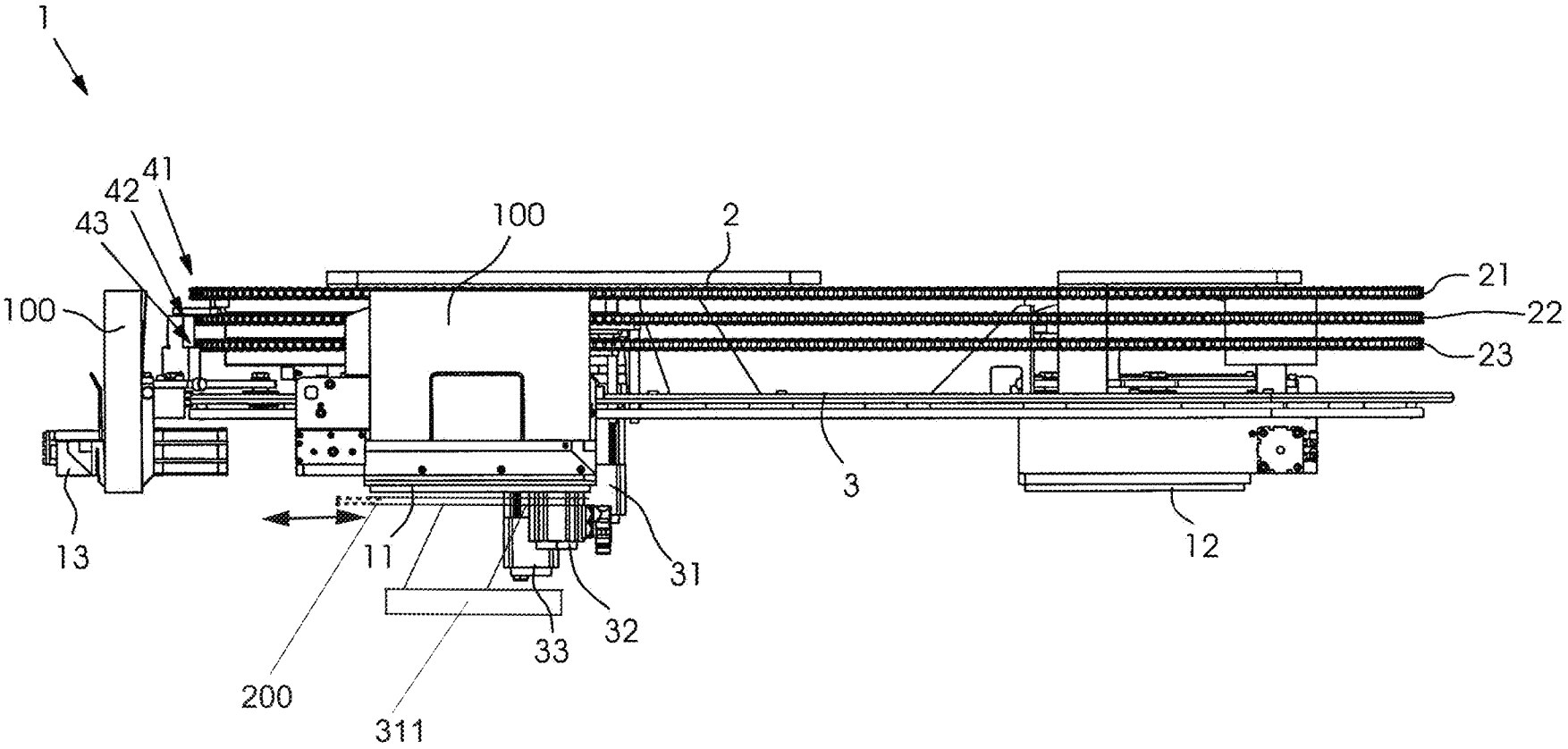
FIG. 2 is a top view of the perfect binder according to FIG. 1.

FIG. 2 is a view of the perfect binder 1 according to FIG. 1 such that the arrangement of the drive chains 21, 22, 23, which are part of a particular drive 41, 42, 43, can be seen clearly. The description of the other reference numerals can be seen from FIG. 1.

In both FIG. 1 and FIG. 2, a device 200 is shown schematically at a stopping position 51, and is operatively connected to the transport clamp 11 that is in use there and intended for the alignment of a book block consisting of single sheets and/or signatures. Said device is designed such that it is capable of ensuring an automatic supply of the individual book blocks. If the individual book blocks are being supplied by hand, then said book blocks are inserted into the transport clamp 13 at a stopping position 53, said book blocks then also being aligned in the stopping position 51 by the device 200 acting there.

Such a perfect binder 1 has the advantage that the output of the perfect binder can be increased as a result of adjusted idle times and different movement profiles in the movement portions. In this respect, an intermediate stopping of the book block flow in order to change over the processing machines can be omitted. The quality of the books or printed products to be manufactured can also be increased since the speed profiles each allow transport speeds and idle times close to the processing optimum. For example, a longer idle time for pressing on the covers can contribute to each cover sticking better to the book block, the book block spine can be shaped better and the book block can cure better. Another advantage is that the processing stations located at the stopping positions along the guide track are free, i.e. can be arranged in an optimal position. It is no longer necessary to arrange the stopping positions at an equal distance from one another. The processing stations can be arranged variably according to customer requirements using a grid along the guide track. Different machine configurations can thus be offered in a simple manner.

The perfect binder 1 has in particular at least two stopping positions for the transport clamps, of which one is for the book block insertion and one is for pressing a cover onto a book block. If applicable, one additional stopping position can be provided for the discharge of finished book blocks. In each of the stopping positions, the transport clamps are brought to a standstill by the drive assigned to each of the transport clamps. It is also possible, for example for manufacturing lay flat brochures, Swiss brochures and "Otabind" bindings, to apply adhesive and lining strips during the first circulation of the book block along the guide track and then adhesive and a cover during a second circulation of the book block along the guide track. For Swiss brochures, the back of the book block is bound by a strip of paper or fabric. The external thrice-scored cardboard cover does not adhere to the spine of the book block but rather to a narrow strip on the last page. In the case of "Otabind", the cover is only adhered to the side of the book block. The back of the cover is scored 6 times. The book block is adhered between the first, second and fifth, sixth score on the cover. The spine of the cover is not adhered to the book block.

For example, an associated idle time can thus be stored for each stopping position. For this perfect binder 1, a different speed can also be stored for each movement portion between the stopping positions; for example the speed in the spine processing station can be greater than in the drying station. "Product-dependent speed profiles" means that said profiles depend on the book or printed product to be manufactured, i.e. for example on its dimensions, the book block thickness, the glue thickness, the adhesive and its properties, the paper material, etc.

The embodiments of such a device 200 that are preferably being used are described in detail with reference to FIG. 3 et seq.

Figure 3:
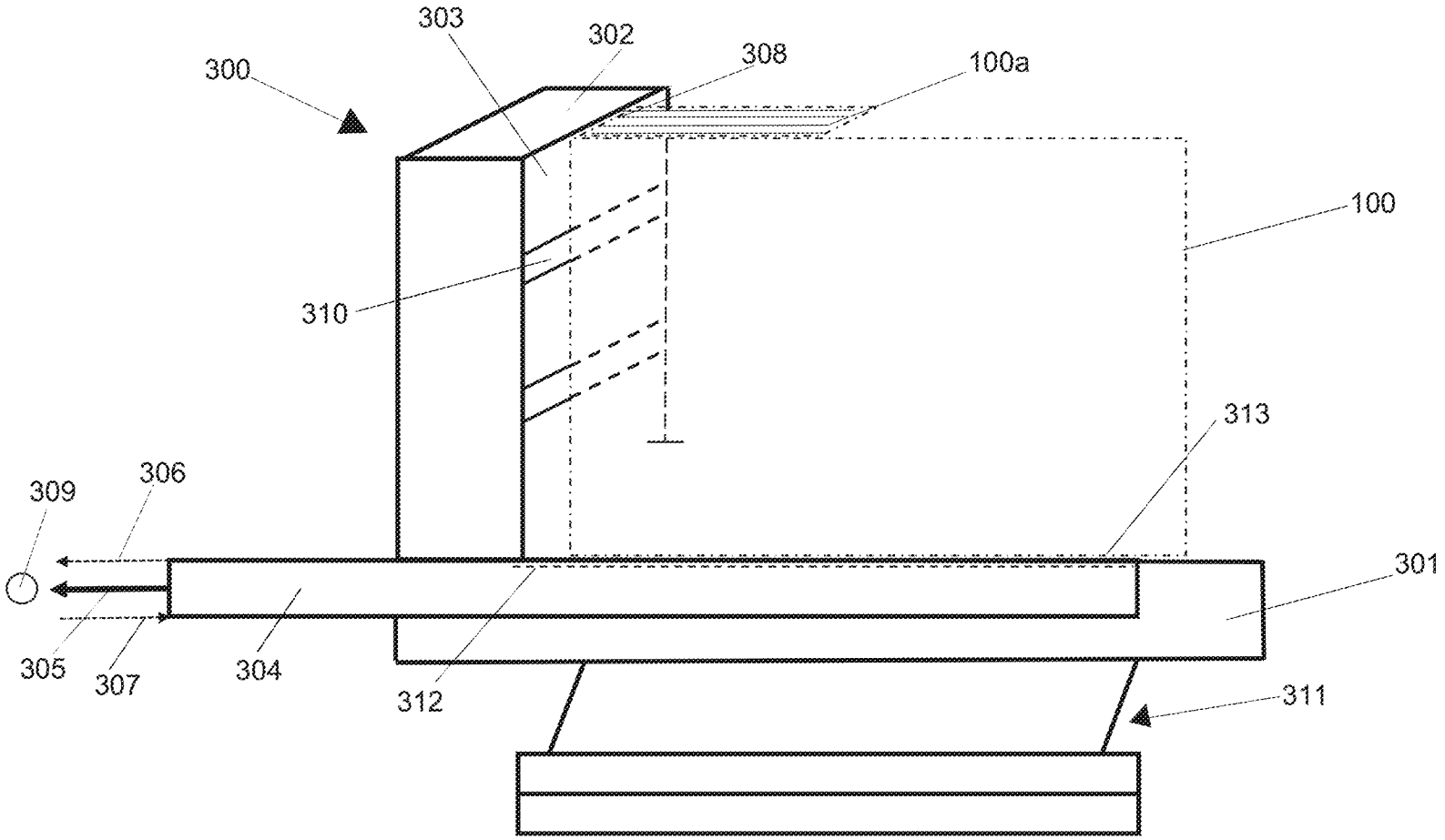
FIG. 3 shows a first embodiment of a device for the alignment of a book block consisting of single sheets and/or signatures.

FIG. 3 shows a device 300 which is designed for aligning a book block 100 consisting of single sheets and/or signatures. Said device is accordingly designed for use in a processing machine, a perfect binder, as illustrated and described for example with reference to FIG. 1 and FIG. 2 for the manufacture of books or printed products.

The device 300 is arranged upstream of a first processing station within the processing machine (see FIG. 1 and FIG. 2), the single book block 100 being fed into the device 300 automatically or, directly or indirectly, by hand. Said device functions as an alignment station and it consists of at least one base plate 301, which has at least one element 302 at the end which extends vertically or virtually vertically and forms a stop surface 303 on the book block side.

The base plate is provided with at least one movement element 304, which performs at least one movement 305, 306, 307 relative to the stop surface 303, said movements being operatively connected to the stop surface 303 depending on the function such that an alignment of the single sheets and/or signatures is brought about therewith for the present book block edge 308.

The movement element 304 consists of a belt or a plate, which fulfil the basic function of a retracting belt or retracting plate, as the denoted movement 305 is intended to show. Generally, the movements 305, 306, 307 to be implemented are defined by a controlled drive 309. The backward movement 305 acting on the book block 100, and on the position of the individual components 100*a*, brings about the achievement of a 100% matching position of the individual components 100*a* between the rear stop edge 308 of the book block 100 and the fixed-position stop surface 303. Typical values for the speed of the backward movement are 50 mm/s. Said speed is variable according to each case, it also being qualitatively and/or quantitatively valid for the movements of the other variants according to FIG. 4-7.

If required, it is provided for the stop surface 303 to have additional damping measures 310 on the element side 302, which achieve a suppression of a "bouncing" of the rear stop surface 308 of the book block 100 with respect to the fixed-position stop surface 303.

Furthermore, the base plate 301 is coupled with a vibration mechanism 311, which is preferably arranged on the underneath, the function of which mechanism is to initiate a separation of the single sheets and/or signatures (see reference sign 100*a*).

The minimum vibration time is about 1 second. Depending on the settings of the pressing time or the thickness settings to be undertaken for the individual processing stations of the perfect binder, it can also be longer or shorter.

However, it has been shown in practice that no 100% operative certainty can be achieved by this vibration function alone that an orderly alignment of at least one book block edge 308 can be achieved with the components (see reference sign 100*a*) of the book block 100 that arrive loose. On the contrary, the perfect alignment is sustainably achieved here by the leading of the book block against a stop surface 303 that is operatively connected to the base plate. Accordingly, the 100% defined alignment of the entire book block is achieved by the activation of said stop surface.

Therefore, if no 100% alignment can be achieved by a vibratory movement alone, then individual components of the book block 100 which are not perfectly aligned are detected early by a light barrier directed onto the stop surface, which acts as a presence control for the book block, whereupon, following said detection, the further processing steps are directly initiated within the perfect binder, in particular such that the transport clamp then starts to function and the further conveying of the book block to a first processing station starts. A correction of a deficient alignment of individual components of the book block can then no longer be remedied.

A deficient alignment in particular of the rear edge of the book block along the carrier surface of the transport clamp, even if the error is only minimal, inevitably leads to losses in quality of the finished book, apart from the processing of such a non-100%-aligned book block also possibly being the cause of damage within the individual processing stations.

However, the vibratory function by the mechanism 311 should not be omitted because such a vibratory function proves to be advantageous for the separation of the single sheets or signatures within the book block. Nevertheless, the presence control of the light barrier (not described in more detail) should then be strictly carried out only in connection with the aligned book block edge 308 on the stop surface side. Therefore, the vibration mechanism 311 should carry out an important but subordinate function, it being subordinate in the sense that the perfect alignment of the components of the book block, in particular with regard to the book block edge 308 on the stop surface side, is brought about causally by the movement element 304, retracting belt or retracting plate.

The present embodiments with respect to the vibrating mechanism 311 also apply integrally to the other embodiments of the device according to FIG. 4-7, in view of the fact that the installation of said vibrating mechanism is also fully justified there and consequently the advantages of such a vibratory function should not be foregone.

The surface of the retracting element 304 on the book block side is preferably provided with a grip structure 312, which is intended to increase the grip with respect to the lower book block edge 313 such that the book block cannot slip away in one or the other direction even in the case of intermittent movements 306, 307 of the retracting element. If the book block 100 is formed by thin single sheets with a tendency to develop a reciprocal high surface tension, it is provided for the retracting element 304, i.e. retracting belt or retracting plate, to perform intermittent backward 306 and forward 307 movements in quick succession, this being with the ultimate purpose of ensuring an alignment of the book block that is ensured beyond the vibratory function. The forward movement 307 primarily has the function of bringing about an intermediate release of tension on the book block edge 308 that is on the stop surface side, it also being possible for this movement to sweep multiple times if required.

Once the book block is integrally perfectly aligned, it is gripped by at least one transport clamp (see FIG. 1 and FIG. 2) and guided to the individual processing stations of the perfect binder.

Figure 4:
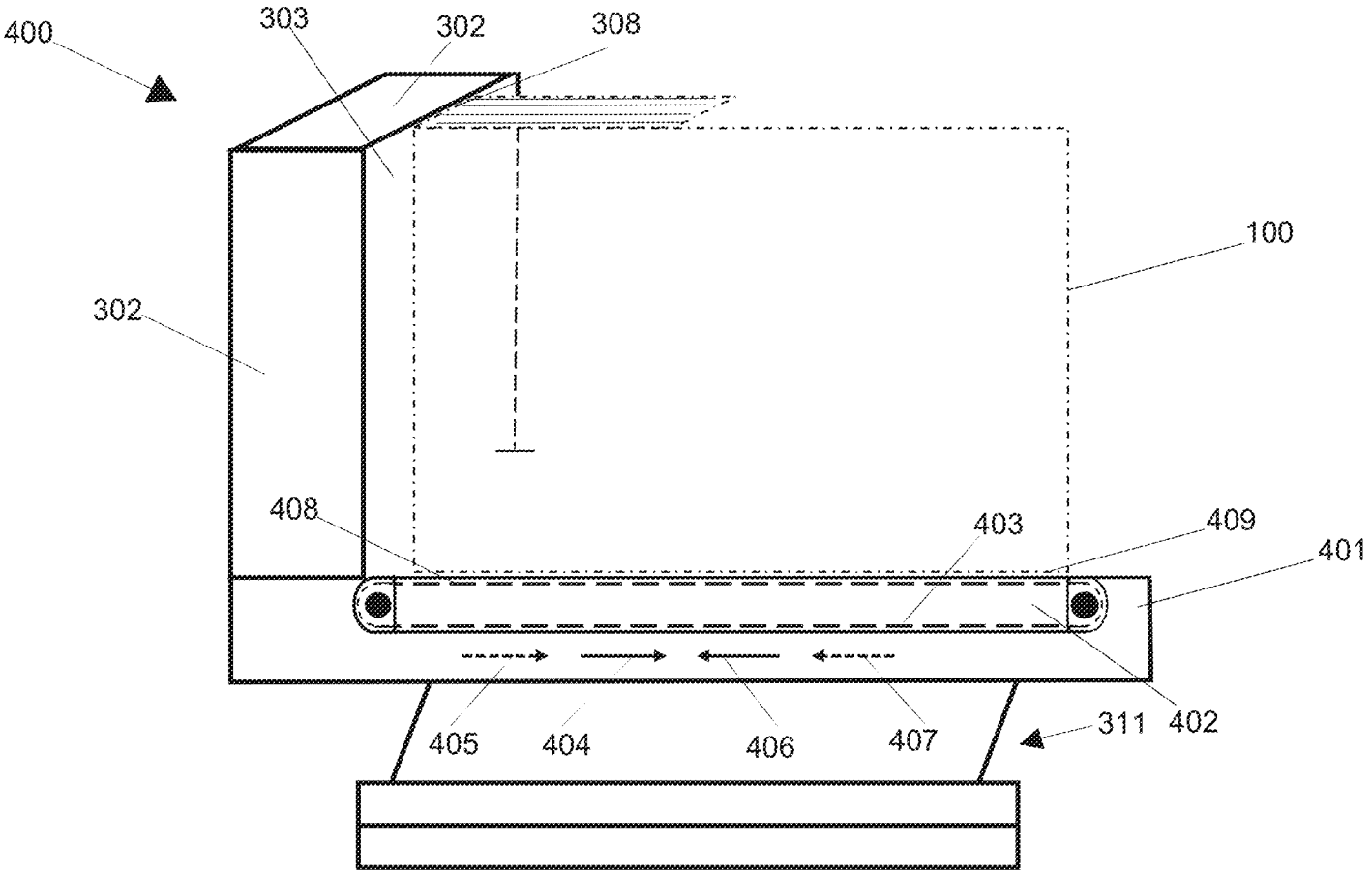
FIG. 4 shows an embodiment of another such device.

FIG. 4 shows another embodiment of a movement element which is designed as a conveyor belt 402 and is integrated into a base plate 401, the basic kinematics of said retracting body being designed as a backward movement 404 of the book block 100, as has already been described in detail with reference to FIG. 3. The conveyor belt 402 extends at a slight distance from its base surface, at least in the region of the gripped surface 408 of the base plate 401, so that no frictional losses can arise. The backward direction of travel 404 of the conveyor belt 402 acting on the book block for generating a perfect alignment is designed to be consistent. As already shown with reference to FIG. 3, an intermittent movement in the direction 405 or another direction can also be implemented. The direction of travel of the conveyor belt 402 can also be designed to change directions 406. The directions of travel of the conveyor belt 402 and their characteristics are always associated with the achievement of a perfect alignment of the book block edge 308 on the stop surface side, as described in detail with reference to FIG. 3. The surface of the conveyor belt 402 on the book block side is preferably provided with a grip structure 403 which is intended to increase the grip with respect to the book block edge 409 on the lower side so that the book block cannot slip away even in the case of intermittent movements 405, 407 of the conveyor belt 402 in one or the other direction.

Figure 5:
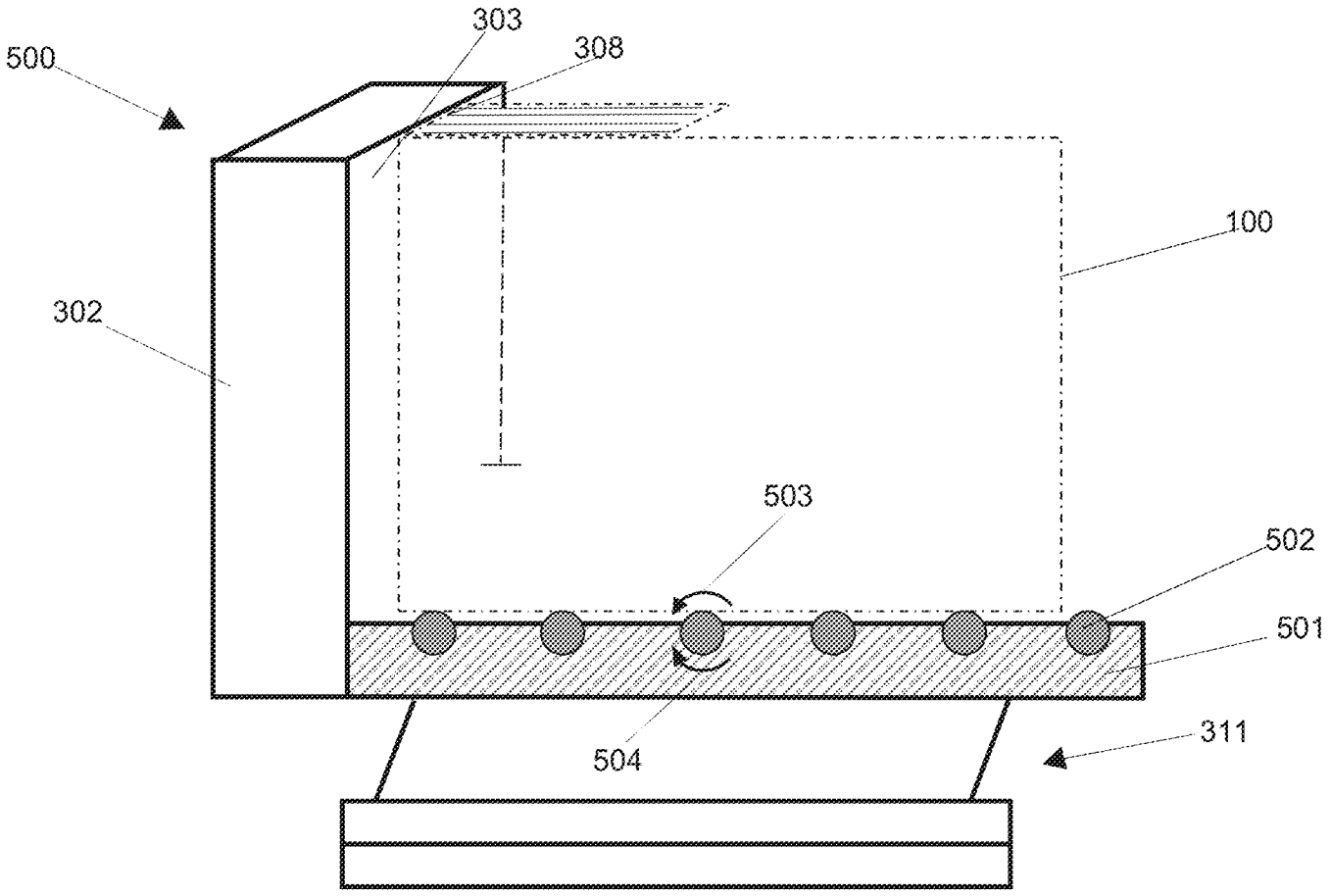
FIG. 5 shows an embodiment of another such device.

FIG. 5 shows another embodiment of how the basic backward movement can be achieved. Said backward movement involves providing the base plate 501 at least partially with rollers 502 mounted inside, which rollers are directly or indirectly operatively connected by means of a drive, and which bring about a linear movement 503 on the book block 100 as a result of their revolutions, said rollers 502 only projecting slightly above the surface of said base plate, as can be seen from FIG. 5.

It can also be provided for the drive of the rollers 502 to be taken out of operation briefly after the completed abutment of the book block edge 308 against the fixed-position stop surface 303, such that the rollers 502 can then rotate freely practically frictionlessly in both directions of rotation, so that no inhibitory effect on the book block can occur as a result of the rollers while said book block is being transported onwards, this preferably being the case even in cases in which the book block is not raised for onward transport to the processing stations (see FIG. 1 and FIG. 2).

After the book block has abutted the fixed-position stop surface, the rollers accordingly instantly no longer have any torque or the torque for the rolling movement is designed such that the rollers are initially idle after the impact and then only rotate freely when the book block is transported onwards. During the subsequent cycle, the rollers are initially driven again until abutment of the book block has occurred.

A rotary movement of the rollers driven briefly beyond the abutment that has taken place is also possible. Such a sustained pressing of the book block edge against the stop surface can be provided in the case of all the variants according to FIG. 3-7.

It is also possible to drive the rollers 502 in the opposite direction 504 in those cases in which an intermediate release of tension on the book block edge 308 on the stop surface side is intended to be achieved, it also being possible for this movement to be sweeping at least once if required.

Once the book block is integrally perfectly aligned it is collected by at least one transport clamp (see FIG. 1 and FIG. 2) and guided through the individual processing stations of the perfect binder.

Figure 6:
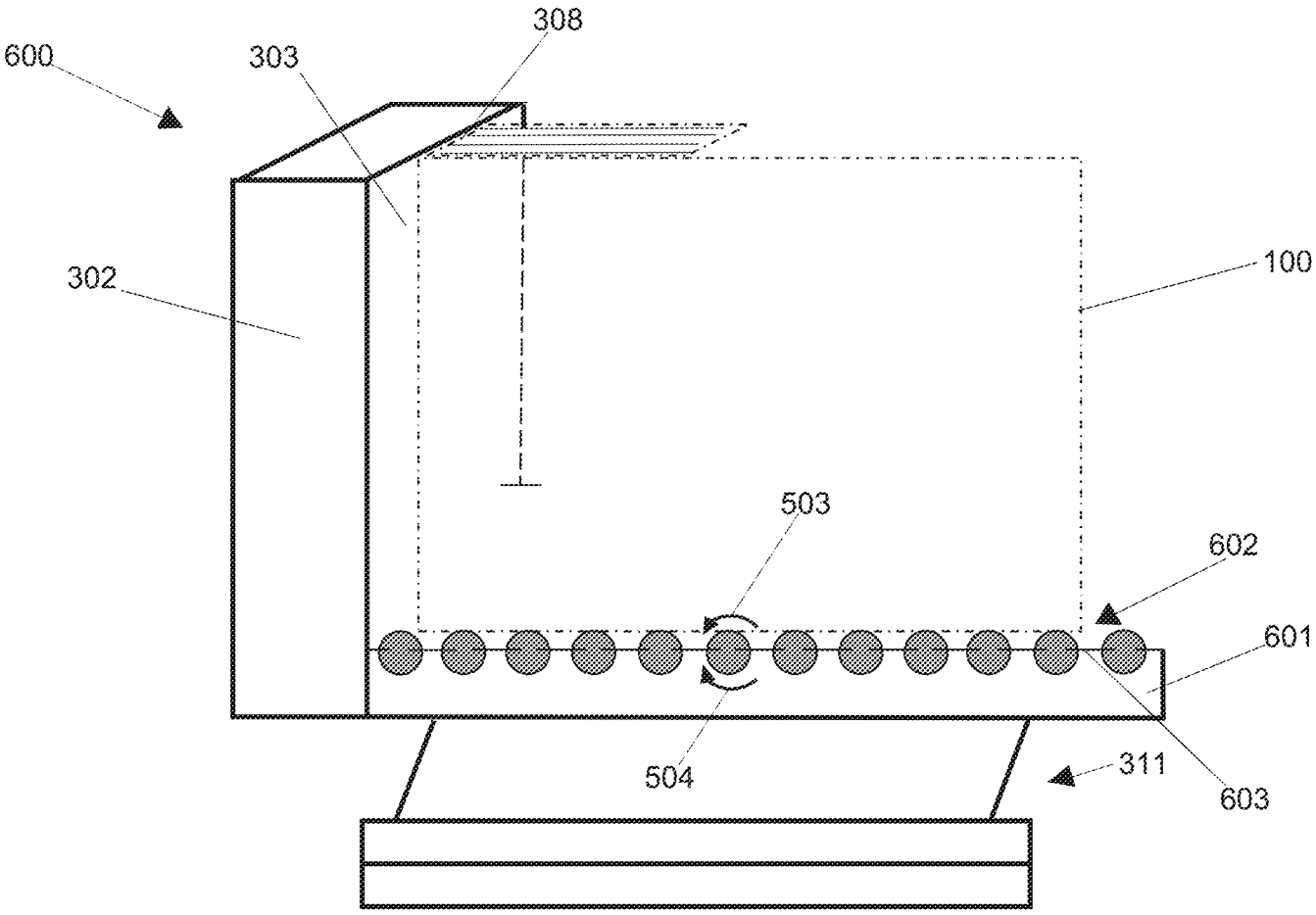
FIG. 6 shows an embodiment of another such device.

FIG. 6 shows another variant which basically has the same construction and mode of operation as described with reference to FIG. 5, provided that the movements 503, 504 (see also the description with reference to FIG. 5) acting on the book block occur as a result of an independent roller conveyor 602, said roller conveyor being surrounded by a frame 601, such a frame not necessarily having to be provided for roller conveyors. The rollers of said roller conveyor 602 are either driven individually or they are driven collectively by one single drive, which the indicated connection 603 acting transversely is intended to express. Intermittent movements in one or the other direction can also be provided here, as has already been described in detail with reference to the preceding FIG. 3-5.

Figure 7:
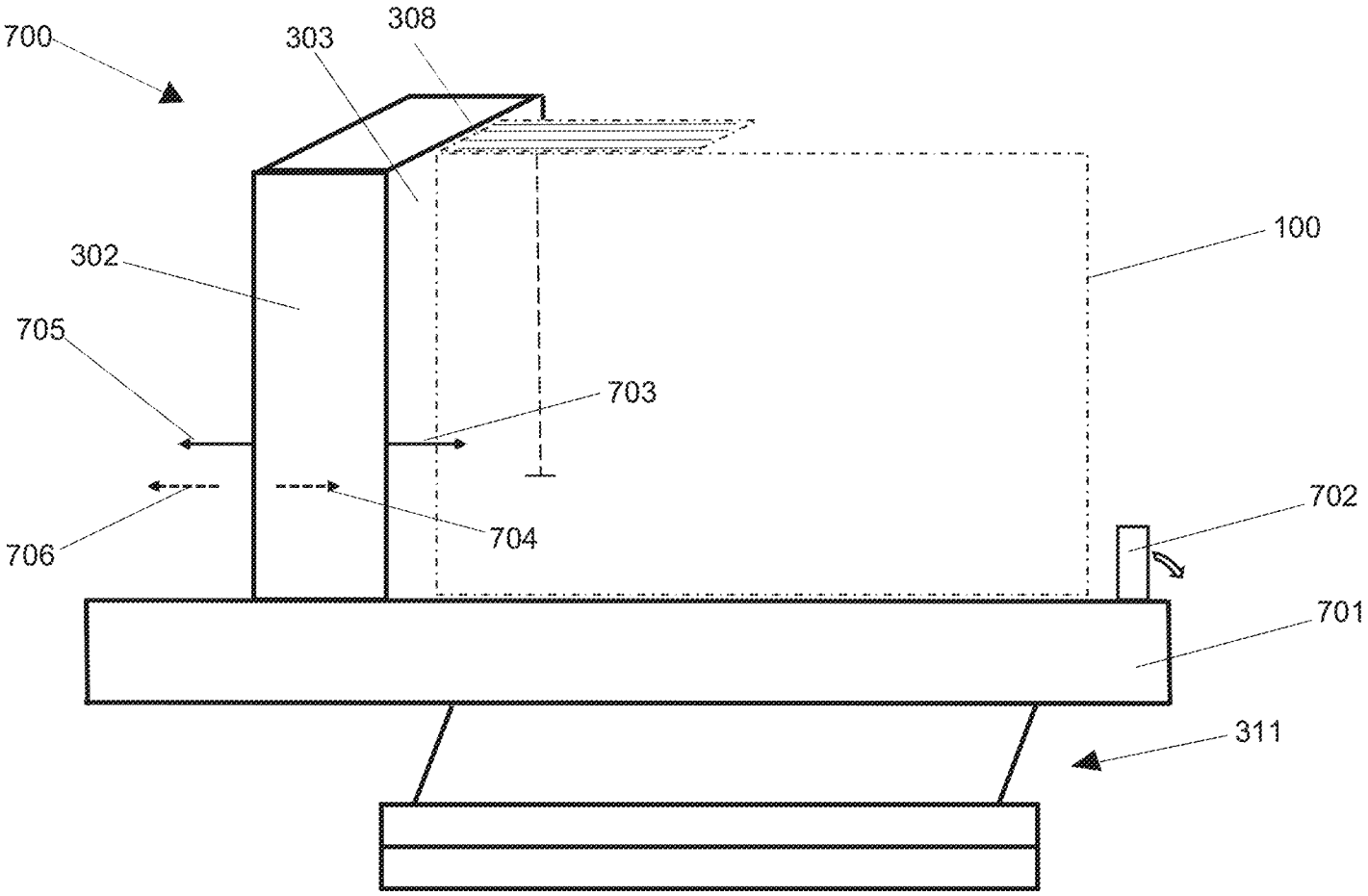
FIG. 7 shows an embodiment of another such device.

FIG. 7 shows another variant of how the alignment of the components of the book block can proceed. The device 700 shown here is again designed for use in a processing machine (see FIG. 1 and FIG. 2) in which the manufacture of books or printed products is carried out, the device being arranged upstream of a first processing station within the processing machine. The book blocks 100 can also be fed into the device automatically or by hand. Said device is formed by at least one alignment station, which consists of at least one base plate 701 or a roller conveyor (see FIG. 5 and FIG. 6), the base plate or the roller conveyor having at least one vertically or virtually vertically extending stop surface at its end.

The stop surface 303, i.e. the entire element 302, moves towards the book block edge 308 on the stop surface side and pushes the book block using the resultant impact force towards the processing stations. While this movement 703 is being executed, an alignment of the components of the book block takes place simultaneously with the support of the vibratory function that has already been described (see description of FIG. 3). The forward movement of the book block is then ended, and consequently the leading edge of the book block 100 has reached a delimitation point 702 present on the base plate 701, which delimitation point consists of at least one mechanical or electronic element. The relevant transport clamp engages at this point, which clamp has moved forward moderately with the book block and then starts to function at this position and conveys the book block to the processing stations.

In FIG. 7, the individual movements carried out by the element 302 are then shown schematically by arrows. Firstly, the forward movement 703 of the element 302 is shown, as a result of which the pushing of the book block 100 takes place. The intermittent movement 704 of the same element 302 that is possible for this purpose should accordingly also be possible if required. On the other hand, FIG. 7 indicates the movements of the element in the opposite direction by means of the arrows 705, 706. All of the movements have the same ultimate purpose, as described with reference to the preceding FIG. 3-6, namely the achievement of a perfect alignment of the book block before it is processed.

While the invention has been illustrated and described in detail in the drawings and foregoing description, such illustration and description are to be considered illustrative or exemplary and not restrictive. It will be understood that changes and modifications may be made by those of ordinary skill within the scope of the following claims. In particular, the present invention covers further embodiments with any combination of features from different embodiments described above and below. Additionally, statements made herein characterizing the invention refer to an embodiment of the invention and not necessarily all embodiments.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B," unless it is clear from the context or the foregoing description that only one of A and B is intended. Further, the recitation of "at least one of A, B and C" should be interpreted as one or more of a group of elements consisting of A, B and C, and should not be interpreted as requiring at least one of each of the listed elements A, B and C, regardless of whether A, B and C are related as categories or otherwise. Moreover, the recitation of "A, B and/or C" or "at least one of A, B or C" should be interpreted as including any singular entity from the listed elements, e.g., A, any subset from the listed elements, e.g., A and B, or the entire list of elements A, B and C.

What is claimed is:

1. A perfect binding machine for manufacturing books or printed products, the perfect binding machine comprising:

a first processing station for processing a book block consisting of single sheets and/or signatures; and a device for alignment of the book block, the device being arranged upstream of the first processing station, the book block being feedable directly or indirectly into the device automatically or by hand, the device comprising:

at least one alignment station having at least one base plate with at least one vertically extending stop surface at an end thereof, the at least one base plate having at least one movable part configured to carry out at least one movement with respect to the stop surface such that the at least one movement of the at least one movable part, in an operative connection to the stop surface, brings about an alignment of the single sheets and/or signatures at at least one book block edge, and such that, following alignment, the book block is grippable by at least one transport clamp for processing, wherein the at least one movable part comprises a retracting belt or a retracting plate, wherein the retracting belt or the retracting plate is configured to act on a surface of the base plate, wherein the retracting belt or the retracting plate is operatively coupled to at least one drive on one side and is configured to bring about the at least one movement in at least one direction with respect to the stop surface by the at least one drive, and wherein a vertical height of the stop surface corresponds to a maximum height of the book block and has a shape that is configured to align the entire book block edge.

2. The perfect binding machine according to claim 1, the perfect binder comprising a control system configured to store or calculate control profiles, and configured to control the device based upon the control profiles.

3. The perfect binding machine according to claim 1, wherein the at least one movement is consistent, intermittent or changes directions.

4. The perfect binding machine according to claim 1, wherein the at least one movable part includes a continuously circulating conveyor belt configured to operate at least partially above the at least one base plate, the conveyor belt having a changeable direction of travel.

5. The perfect binding machine according to claim 4, wherein the direction of travel of the conveyor belt is consistent, intermittent or changes directions.

6. The perfect binding machine according to claim 1, wherein a surface of a movement element of the at least one movable part on the book block side has a grip structure configured to increase grip.

7. The perfect binding machine according to claim 1, wherein the retracting belt or the retracting plate are configured to directly support the book block, and are configured to be controllably released from the base plate in order to carry out the at least one movement.

8. A perfect binding machine for manufacturing books or printed products, the perfect binding machine comprising:

a first processing station for processing a book block consisting of single sheets and/or signatures; and a device for alignment of the book block, the device being arranged upstream of the first processing station, the book block being feedable directly or indirectly into the device automatically or by hand, the device comprising:

at least one alignment station having a number of driven or freely rotatable rollers which are arranged next to one another and which are operatively connected to a base plate or form an integral roller conveyor, the book block being moveable on the rollers towards at least one stop surface arranged at an end such that, as a result of at least one movement operatively connected to the stop surface, the book block undergoes an alignment of the single sheets and/or signatures at at least one book block edge, and such that, following alignment, the book block is grippable by at least one transport clamp for further processing, wherein the rollers are arranged inside the base plate and are rotatable in at least one direction, wherein one dimension of the rollers projects out of a surface of the base plate, wherein upper sides of the rollers form a movement plane of the book block, wherein the rollers are drivable directly or indirectly, such that the rollers are subjected to torque at least until the rear book block edge lines up with the stop surface so as to have positional stability, and wherein the at least one direction of rotation of at least one of the rollers is consistent, intermittent or changes direction.

9. The perfect binding machine according to claim 8, wherein the rollers form the integral roller conveyor, which forms a movement plane of the book block, and wherein the rollers of the roller conveyor are drivable directly or indirectly, such that the rollers are subjected to torque at least until the rear book block edge lines up with the stop surface so as to have positional stability.

10. A perfect binding machine for manufacturing books or printed products, the perfect binding machine comprising:

a control system configured to store or calculate control profiles;

a first processing station for processing a book block consisting of single sheets and/or signatures; and a device for alignment of the book block, the device being arranged upstream of the first processing station, the book block being feedable directly or indirectly into the device automatically or by hand, the device comprising:

at least one alignment station which having at least one of a base plate, a base plate equipped with rollers and a roller conveyor, which has at least one vertically extending stop surface at an end thereof, the stop surface being configured to move forward to generate a movement exerted on the book block towards the processing station such that the book block, as a result of the movement, undergoes an alignment of the single sheets and/or signatures at at least one book block edge, wherein the movement of the book block is completed at a state in which the leading book block edge matches a delimitation point on the base plate or the roller conveyor, at which point the book block is grippable by a transport clamp for further processing, wherein the control system is configured to control the device based upon the control profiles.

11. The perfect binding machine according to claim 10, wherein the perfect binding machine is a perfect binder line or a perfect binder.

12. The perfect binding machine according to claim 10, wherein the that the perfect binding machine essentially consists of a spine processing station, a glue application station, a pressing station, and a cover feeder, and a number of transport clamps, wherein one of the spine processing station, the glue application station, the pressing station, or the cover feeder is the first processing station.

13. The perfect binding machine according to claim 12, wherein the number of transport clamps is equal to, greater than or smaller than the number of processing stations.

14. The perfect binding machine according to claim 10, wherein the at least one of the base plate, the base plate equipped with rollers and the roller conveyor is coupled to a vibrating mechanism.

15. The perfect binding machine according to claim 14, wherein the vibrating mechanism is configured to be in use before or during use of a movement element, the rollers or the roller conveyor.

* * * * *